United States Patent [19]

Drzewiecki et al.

[11] Patent Number: 4,512,371

[45] Date of Patent: Apr. 23, 1985

[54] PHOTOFLUIDIC INTERFACE

[75] Inventors: Tadeusz M. Drzewiecki, Silver Spring; Kenji Toda, Rockville; John Gurney, Kensington, all of Md.

[73] Assignee: The United States of America as represented by the Secretary of the Army, Washington, D.C.

[21] Appl. No.: 503,454

[22] Filed: Jun. 13, 1983

[51] Int. Cl.[3] ..... F15C 1/04; F15C 1/08; F15C 1/12

[52] U.S. Cl. ..... 137/828; 137/821; 137/840; 137/1; 250/351

[58] Field of Search ..... 137/819, 821, 828, 835, 137/840, 1; 250/351

[56] References Cited

U.S. PATENT DOCUMENTS

| | | | |
|---|---|---|---|
| 3,228,411 | 1/1966 | Straub | 137/827 |
| 3,552,414 | 1/1971 | Sutton | 137/821 |
| 3,568,693 | 3/1971 | Vandrey | 137/1 |
| 3,591,809 | 7/1971 | Laakaniemi et al. | 137/827 |
| 4,184,768 | 1/1980 | Murphy et al. | 356/326 |

*Primary Examiner*—A. Michael Chambers

*Attorney, Agent, or Firm*—Anthony T. Lane; Robert P. Gibson; Saul Elbaum

[57] ABSTRACT

A photofluidic interface that transduces optical control signals into fluid control pressures is provided in which an AC modulated light source is utilized to transmit control signals to a photo acoustic cell that absorbs the light energy and converts it to heat energy thus creating pressure pulses within the cell. The output signal of the photo acoustic cell is then fluidically amplified, fluidically rectified and again fluidically amplified to create an output signal that drives an actuator.

19 Claims, 13 Drawing Figures

PHOTOFLUIDIC INTERFACE

RIGHTS OF THE GOVERNMENT

The invention described herein may be manufactured, used and licensed by or for the U.S. government for governmental purposes without the payment to us of any royalty thereon.

BACKGROUND OF THE INVENTION

This invention relates to a photofluidic interface that transduces optical control signals to pneumatic or hydraulic control pressures using only fluidic and thermal devices for its control system. A typical application would employ a laser or light emitting diode (LED) modulated light source to send carrier wave control signals through an optical fiber to a remote location where the photofluidic interface would produce analog pressures for driving a valve, piston or other actuator. Thus, beyond the point of the modulated light source, the control system will require no electronic devices or electrical power to operate.

The significant advantage of this invention over the prior art is that it provides a means for the elimination of electronic devices to accomplish the optical to pneumatic or hydraulic transduction, which is very important when the operation of electronic devices may be hazardous, or undesirable for other reasons.

It is known in the prior art to use a photo diode to receive an optical signal and convert it to an electrical signal. This electrical signal is then converted into mechanical motion which in turn controls a pneumatic or hydraulic valve, switch or actuator. This scheme is sensitive to environmental hazards because the photo diode can become inoperative or be destroyed in the presence of electromagnetic radiation, extreme temperatures, or shock. The photo diode output current in this alternative must also be converted to a useable voltage to drive a solenoid or other actuating device, thus requiring that electrical power be available at the remote control station or location. This can present a threat to the reliability of the system due to the susceptibility of the system to power failures, radiation and extreme temperatures. Also, the requirement for the use of electrical power can threaten the safety in hazardous environments such as in the presence of explosive gases which could be detonated by electrical current.

By contrast, the photofluidic interface is much less susceptible to radiation, extreme temperatures and shock. It requires no electrical power at the remote station or location and therefore presents no spark-detonation hazard. Further, the photofluidic interface employs no moving parts. It, therefore, benefits from the increased reliability similar to other fluidic devices.

SUMMARY OF THE INVENTION

A photofluidic interface to transduce optical control signals into pneumatic or hydraulic control pressures has been provided in accordance with this invention. A pulsed or AC modulated light source is used to transmit control signals to a photo acoustic cell that absorbs the light energy and converts it into heat energy thereby creating pressure pulses or AC pressures within the cell. The output signal of the photo acoustic cell is then amplified by a fluidic amplifier to boost the low level signal to a higher level and/or to effectively couple the input pressure signal to an output device. The amplified signal is then rectified by a fluidic rectifier to convert the modulated AC fluidic signals to varying DC pressure signals. The rectified pressure signal output is then amplified by a second fluidic amplifier to boost the DC power or pressure output of the rectifier to a higher level and to provide differential DC control pressures.

It is an object of this invention to provide a photofluidic interface that will transduce optical control signals into pneumatic or hydraulic control pressures utilizing only fluidic and thermal devices.

It is an object of this invention to eliminate the use of photo diodes and other electronic components in a control system for a mechanical actuator.

It is an object of this invention to eliminate the need for electrical power to operate a control system at a location which may be susceptible to power failures, radiation, vibration, shock and extreme temperature.

BRIEF DESCRIPTION OF THE DRAWINGS

Further details are explained below with the help of the examples illustrated in the attached drawings in which.

DESCRIPTION OF THE PREFERRED EMBODIMENTS

Figure 1:
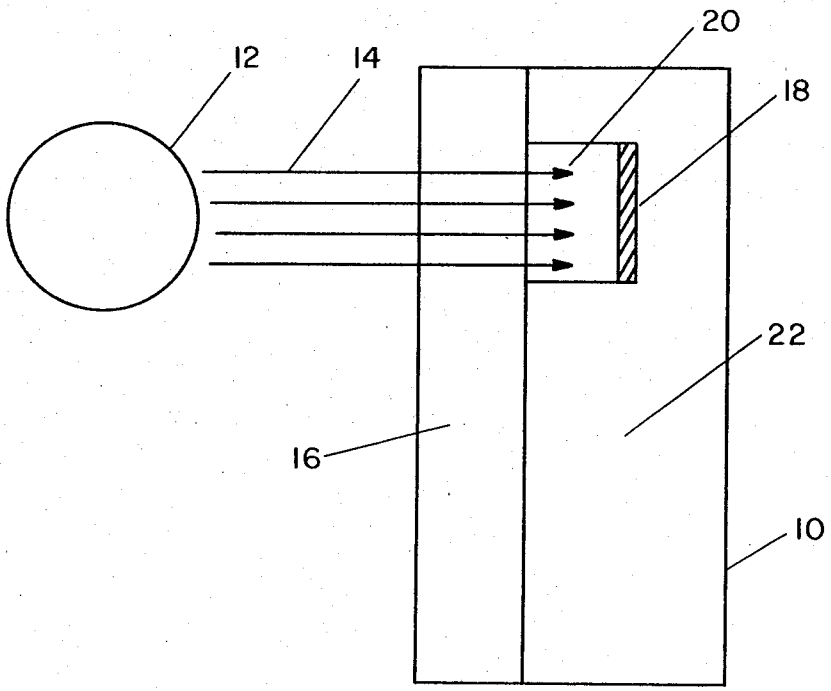
FIG. 1 is a side view of the photo acoustic cell and modulating light source.

In the drawings beginning with FIG. 1, the first or input section of the photofluidic interface is photo acoustic cell 10. Modulated light energy 14 enters the fluid filled cell 10 through transparent window 16 or through an optical fiber.

In a typical application the modulated light source 12 can be a laser or LED sending control signals through an optical fiber (not shown) to a remote location where the photo acoustic cell 10 would be located.

The photo acoustic cell 10 is designed such that most of the light energy falls on a light absorbing target material 18 covering one wall of cell 10. The cell wall material 22 can be made of a metal such as steel. The light absorbing target material 18 can be made of carbon black or a similar type light absorbing material. The cell 10 also contains a volume of fluid 20 such as air located adjacent the light sensitive target material 18. In operation, the target material 18 absorbs the light energy converting it to heat energy, thereby raising the temperature of target material 18. By thermal diffusion, this rise in temperature also raises the temperature of a layer of fluid 20 adjacent the surface of the target material 18 thereby causing the layer of fluid to expand. This periodic expansion of the fluid layer is equivalent to an acoustic current. In a closed cell volume a chopped, pulsed or otherwise continuously modulated light input will, by this mechanism, create pressure pulses within the cell which are the result of the acoustic current.

Treating this case as a one dimensional thermal diffusion problem the governing equations are:

$$\text{Cell wall material } \alpha_b \frac{\partial^2 T_b}{\partial x^2} - \frac{\partial T_b}{\partial t} = 0 \quad (1)$$

$$\text{Absorber } \alpha_a \frac{\partial^2 T_a}{\partial x^2} - \frac{\partial T_a}{\partial t} = \frac{\alpha\beta}{C_{pa}} I_o \exp(-\beta x) \quad (2)$$

$$\text{Gas } \alpha_g \frac{\partial^2 T_g}{\partial x^2} - \frac{\partial T_g}{\partial t} = -\frac{1}{C_{pg}} \frac{\partial P_g}{\partial t} \quad (3)$$

$$\text{Window } \alpha_w \frac{\partial^2 T_w}{\partial x^2} - \frac{\partial T_w}{\partial t} = 0. \quad (4)$$

where

T=temperature amplitude
x=distance measured from gas/absorber boundary
t=time
$\alpha$=thermal diffusivity of material
$\beta$=optical absorption coefficient of absorber
$C_p$=specific heat per unit volume
P=pressure amplitude
$I_o$=input light intensity Subscripts— a—absorbing target material
g—gas or fluid filling the cell
w—window material through which light enters
b—cell wall material (e.g. steel)

Equations (1) and (4) are instances of the energy equation for a rigid material with no internal heat source. The heat source term in Equation (2) represents heat added within the carbon black due to thermal absorption of optical energy. In this case, we assume the light intensity, I, decays exponentially as it enters the absorber.

$$\partial I/\partial x = -\beta I \quad (5)$$

The layer of carbon black is a broadband optical absorber with an estimated absorption coefficient, $\beta$, of $10^6\,\text{cm}^{-1}$. Therefore virtually all of the heat generation takes place within $10^{-5}$ cm of the surface.

The rightmost term in Equation (3) accounts for the fact that the gas stores energy through compression as well as within its thermal mass. Equation (3) discounts effects of fluid motion such as convection as well as internal energy dissipation as in a first order acoustic approximation. Heat generation within the gas is also discounted because the optical absorption within the air is negligible for the intended optical wavelengths.

Solutions to these equations show that the pressure amplitude as well as acoustic current amplitude generated within a closed cell is a function of 1/F, where F is the carrier wave frequency of the optical input signal. Thus, as the carrier frequency increases the photo acoustic signal amplitude decreases.

For reasons discussed below, a frequency of 1400 Hz was chosen as the optical modulation frequency in the typical device used for illustration of this invention. It follows from the above analysis that in the gas, virtually all of the periodic temperature rise occurs within a distance of $2\pi(2\alpha g/\omega)^{\frac{1}{2}}$ of the absorber surface. At a modulation frequency of 1400 Hz this thermal boundary layer is only 0.042 cm thick. Hence, the depth of the cell (distance from absorbing target wall to optical entrance window) needs only to be greater than this amount to prevent unwanted loss of heat out the window. Within the carbon black target the thermal boundary layer $2\pi(2\alpha a/\omega)^{\frac{1}{2}}$, is thinner by one order of magnitude (0.0042 cm) than within the gas. Hence, any deposit of target material thicker than 0.004 cm will perform optimally at 1400 Hz. There will then be no unwanted periodic heat loss through the steel back plate. Very thin deposits of carbon black could perform less well. While the estimated thermal mass of the absorbing material is $C_{pa}$*(thickness)*area, only that thickness within $2\pi(2\alpha_a/\omega)^{\frac{1}{2}}$ of the inner boundary participates in the periodic temperature rise. Generally, then only a small amount of light absorbing material participates in the periodic heat rise. Thus, this method of carrier wave, photo acoustic, transduction offers a much lower thermal load than the other DC methods referred to as prior art which require heating of an entire capillary tube. These considerations also suggest a thermal figure of merit for any optically thick absorbing target material.

$$TM_a \sim [C_{pa} 2\pi(2\alpha_a/\omega)^{\frac{1}{2}}]^{-1}$$

or for carbon black $$TM_a = (\alpha_a/\kappa_a^2)^{\frac{1}{2}} = 135. \quad (6)$$

The temperature amplitude available at the gas/target boundary is proportional to $TM_a$. Any optically thick material with a higher TM will perform better (yield a higher pressure/acoustic current signal) than carbon black.

By properly choosing target material, target thickness and cell depth, one can maximize the achieved acoustic current amplitude. For a given modulated light energy, target and cell construction there is a given acoustic current present within the fluid at the target surface. For example, for the laboratory model carbon black, which has a thermal figure of merit of approximately 135, was chosen as the target material; the target thickness was selected to be at least 0.004 cm at an optical modulation of 1400 Hz; and the cell depth was selected to be a minimum of 0.042 cm thick.

Figure 2:
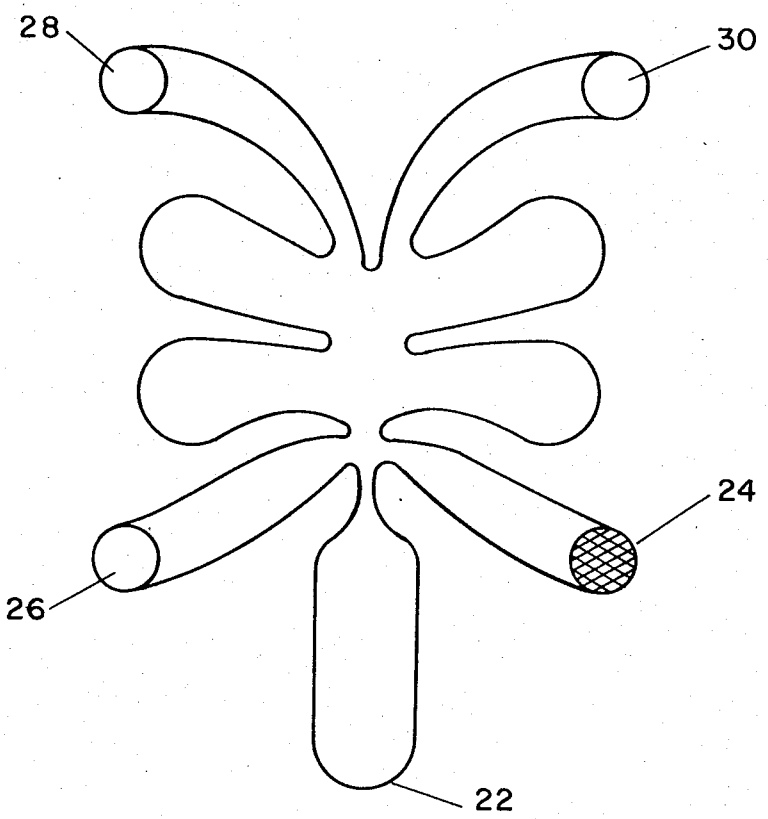
FIG. 2 is a plan view of a single stage fluidic amplifier that amplifies the output of the photo acoustic cell.

The second section of the photofluidic interface uses one or more stages of a fluidic amplifier 22 such as the laminar proportional amplifier (LPA) of FIG. 2. This type of fluidic amplifier is a much improved refinement of the original turbulent fluidic amplifiers. An LPA is capable of operating at a relatively high frequency, a few kilohertz, and contributes a very low level of internal noise. This makes it possible to operate the invention using light sources of a few milliwatts optical power or less.

Figure 3:
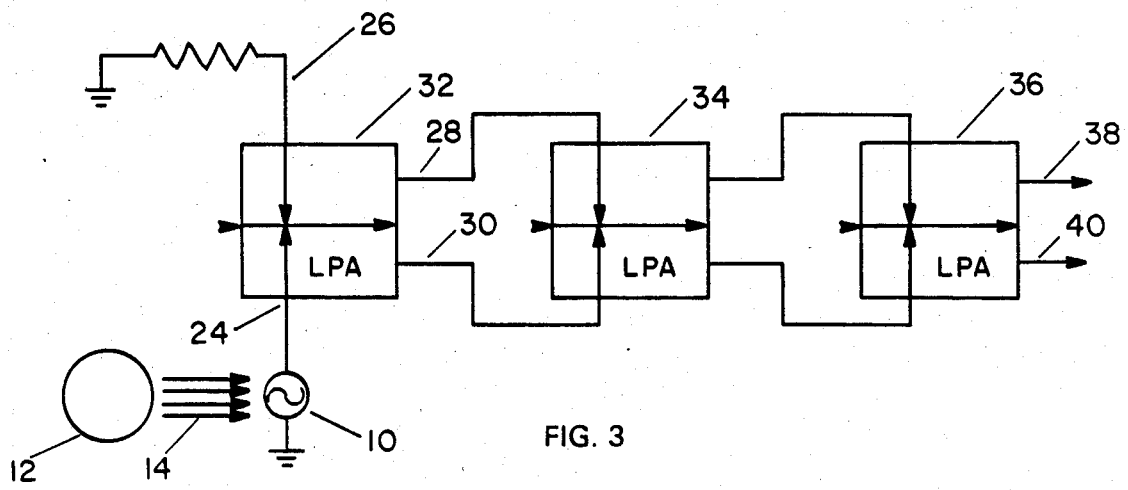
FIG. 3 is a schematic diagram illustrating a multistaged fluidic amplification of the output pressure of the photo acoustic cell.

By connecting one input 24 of the fluidic amplifier 22 to acoustic cell 10, the photo acoustic current that is created within the cell becomes the acoustic signal driving amplifier 22. The fluidic amplification could also be performed in multiple stages as is illustrated in the schematic diagram of FIG. 3. In the multistaged amplifier the photo acoustic AC current creates an AC pressure at the fluidic amplifier input 24. This pressure is then amplified by a group of fluidic amplifier 32, 34 and 36 connected in series. The other input 26 can be open to ground or it can be connected to another photo acoustic cell receiving optical control signals from another light source. In the latter configuration the first stage amplifier 32 would be driven push-pull.

Figure 9:
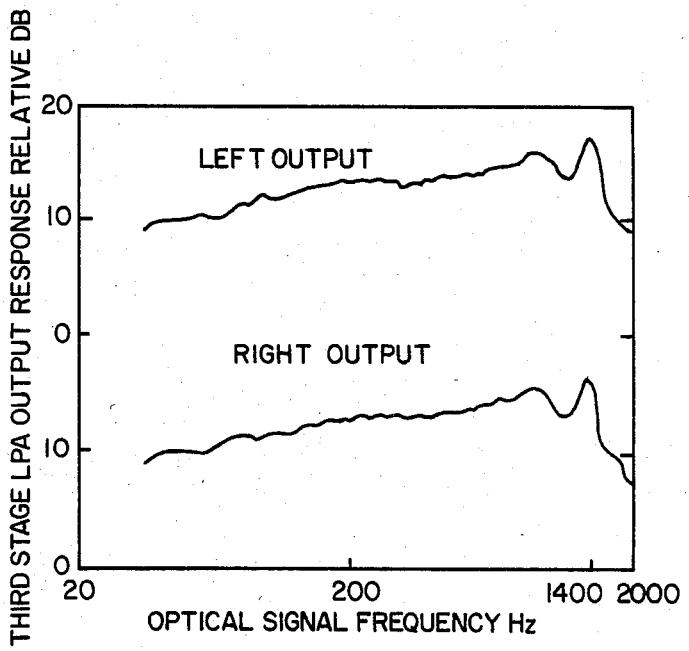
FIG. 9 is a graph illustrating a typical laminar proportional amplifier frequency response plot.

A typical experimental photofluidic LPA frequency response plot is shown in FIG. 9. The ordinate is a measure of output rms acoustic pressure shown at 38 and 40 divided by input 14 rms optical power. This typical curve rises with frequency reaching a maximum resonance point, about 1400 Hz in this case, then falling rapidly for higher frequencies. The internal input impedance of the LPA along with internal acoustic feedback within the LPA determine the shape of this curve. Thus, although the actual driving signal to the LPA within the acoustic cell falls with 1/frequency, the output signal from the second section superimposes a different frequency response behavior. The normal design preference would be to choose a carrier frequency which is both high enough to provide adequate system response but not so high (e.g. beyond 1400 Hz) as to yield too weak an acoustic current signal within the cell. In the typical case of FIG. 9, the resonant peak frequency of 1400 Hz would be chosen as the carrier wave frequency. By choosing LPA's of various other dimensions, the resonant peak of the photofluidic frequency response plot can be moved higher or lower.

Figure 4:
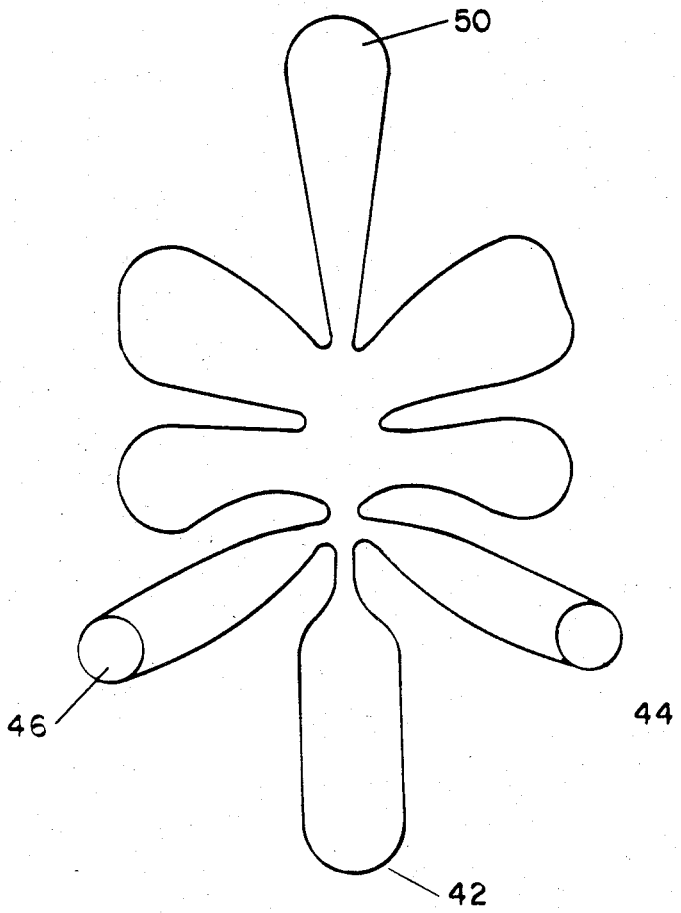
FIG. 4 is a plan view of the fluidic rectifier.
Figure 5:
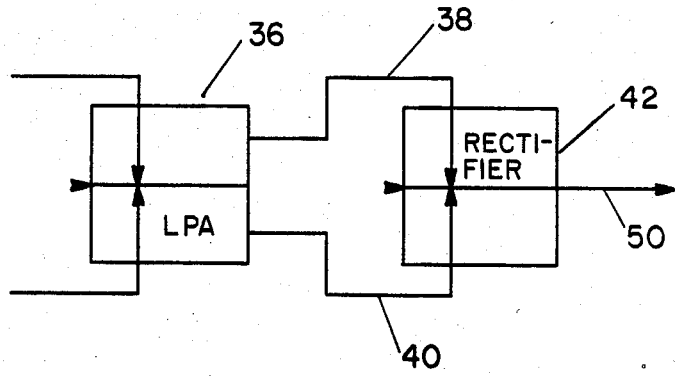
FIG. 5 is a schematic diagram illustrating how the output of the first fluidic amplifier is connected to the fluidic rectifier.
Figure 10:
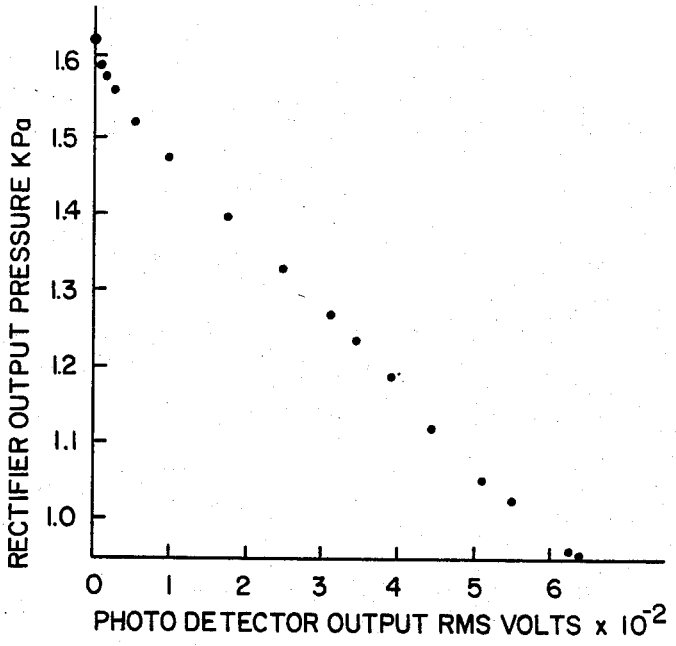
FIG. 10 is a graph illustrating how the rectifier output pressure varies with a laser light source output that is amplitude modulated.

The third section of the photo acoustic interface is a fluidic rectifier 42 as is illustrated in FIG. 4. The outputs, either 28 and 30 for the single stage amplifier or 38 and 40 for the multistage amplifier, connect to the inputs 44 and 46 of rectifier 42. Rectifier 42 doubles the signal frequency applied to its inputs 44 and 46 and produces a DC pressure output that varies inversely with the input pressure signal amplitude. There will be an AC ripple (at the doubled frequency) imposed on the DC rectifier output pressure. In the preferred embodiment, this ripple will be attenuated or eliminated by low pass filtering in the remaining sections of the interface. These sections include capacitive connecting lines and further stages of LPA (discussed below) which have a band pass below the ripple frequency. And, in typical applications a fluid actuator driven by the interface will not respond to the high frequency (e.g., 2800 Hz) ripple pressure. The output 50 of the fluidic rectifier 42 can be controlled by controlling the modulated light input signal 14 in various ways. Four examples are described below:

(1) By modulating the input light power amplitude at fixed frequency the DC rectifier output will vary with light modulation power as shown in FIG. 10. This is due to the fact that the acoustic current within the photo acoustic cell is directly proportional to the input light power amplitude.

Figure 11:
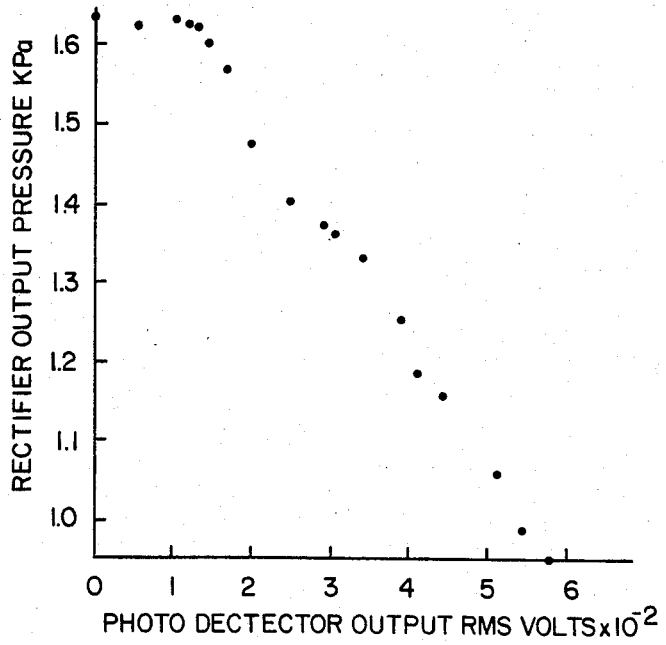
FIG. 11 is a graph illustrating how the rectifier output pressure varies with a laser light source output that is pulse width modulated.

(2) By modulating the light power at fixed frequency and fixed amplitude but with varying duty cycle. A duty cycle of 50% will produce the maximum rectifier output pressure difference (P(no signal)−P(with signal)). Lesser duty cycles will produce smaller pressure differences as is shown in FIG. 11. This is due to the fact that the acoustic current amplitude generated in the photo acoustic cell is proportional to the rms value of the fundamental carrier frequency.

Figure 12:
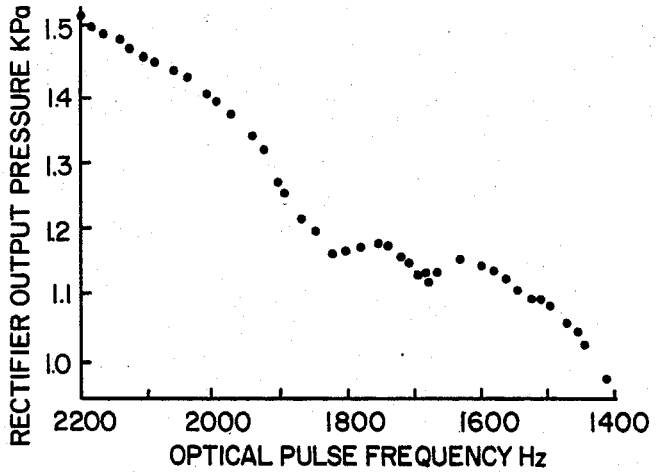
FIG. 12 is a graph illustrating how the rectifier output pressure varied with a laser light source output that is frequency modulated.

(3) By modulating the light power at fixed amplitude and varying the frequency over a band where the LPA output response is not flat as shown in FIG. 12. This will vary the rectifier output pressure because the input pressure level to the rectifier will vary with frequency as already shown in FIG. 9.

Figure 13:
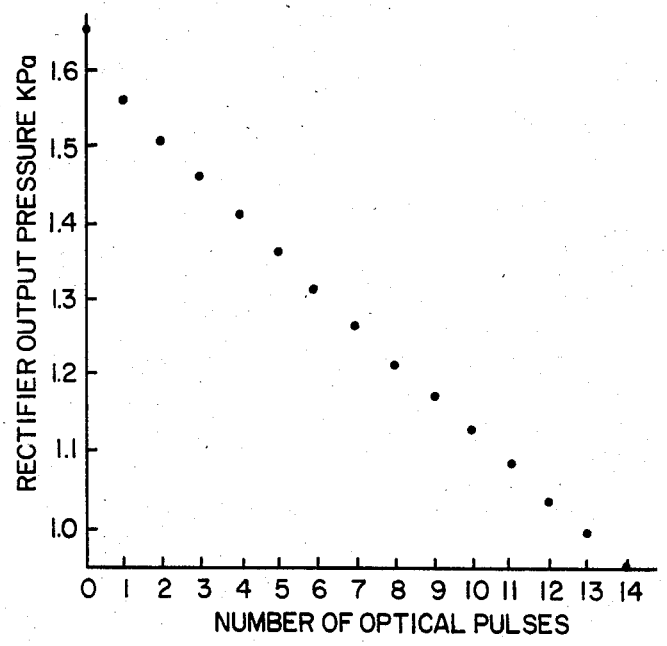
FIG. 13 is a graph illustrating how the rectifier output pressure varies with a laser light source output that is gate width modulated.

(4) By gating a fixed frequency, fixed amplitude modulated input light signal. Here the modulation frequency is chosen at some desirable value. The DC output pressure is an rms value which varies from a minimum for 100% gate duty cycle (equivalent to case (1) above) to a maximum of P(no signal) for 0% gate duty cycle as is shown in FIG. 13.

In each of the four above modulation methods the periodic AC light signal acts as a carrier wave.

Figure 6:
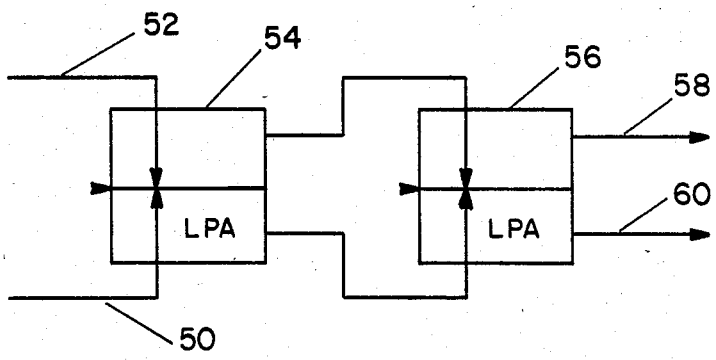
FIG. 6 is a schematic diagram illustrating the fluidic amplification of the fluidic rectifier output.

The last section of the photofluidic interface consists of one or more stages of a fluidic amplifier, such as the amplifier shown in FIG. 2, with one input connected to the rectifier output $P_R$ shown at 50 of FIG. 6. These stages serve to amplify the rectifier output, either DC pressure or DC power. Well known combinations of series connected and parallel connected staging can be employed to achieve pressure gain, power gain or both. By supplying a balancing DC pressure $P_B$ shown at 52 to the laminar proportional amplifier control opposite the rectifier output 50, the device outputs 1 and 2 shown at 58 and 60 can be made to behave in either of two ways:

(1) By setting $P_B$ equal to $P_R$ (with no light signal) the differential pressure across outputs 1 and 2 is zero when no signal is applied. When the light signal is turned on, P1−P2 becomes positive and increases according to the behavior described above.

(2) By applying a smaller $P_B$, P1 will be at a minimum and P2 maximum with no light signal. With maximum light signal, P1 will be maximum and P2 minimum. Thus, differential output pressure swings from positive to negative are achieved.

The outputs 1 and 2 shown at 58 and 60 or the output from the rectifier shown at 50 can be used to move fluid piston or bellows type actuators proportionally or digitally as controlled by the modulated light signal. Alternatively, the outputs can be connected to other types of fluid amplifiers such as diaphragm amplifiers to achieve high level control pressures.

Although the embodiment described here uses the gas, air, as working fluid, essentially similar devices can use other gases such as helium or xenon, or liquids such as glycerin or hydraulic oil.

Figure 7:
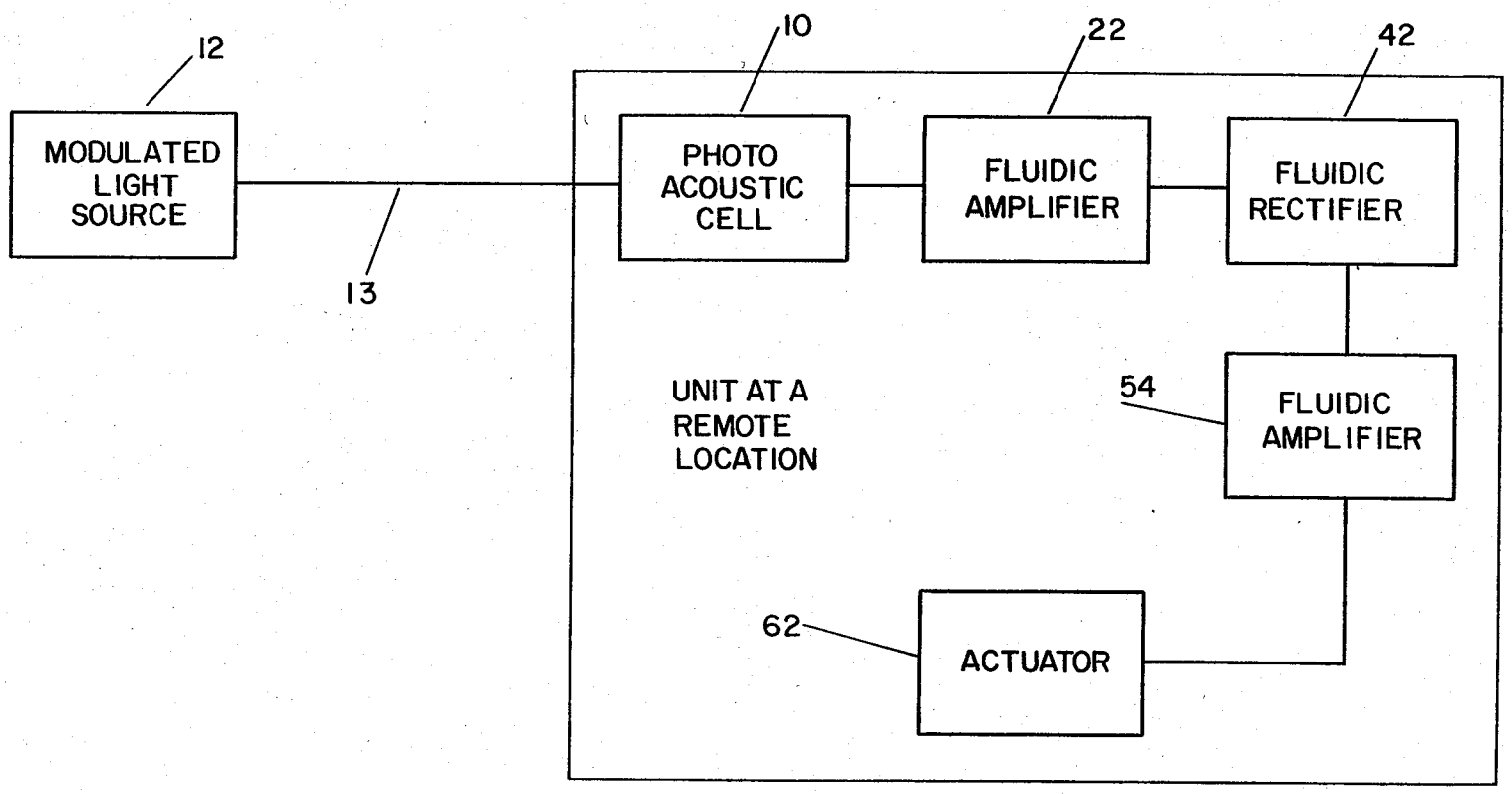
FIG. 7 is a block diagram illustrating how the components of the photofluidic interface interrelate.

FIG. 7 is a block diagram illustrating how all the components of the photofluidic interface would interrelate such as when a unit is utilized in a remote location. The light energy from a modulated light source 12 is directed into a photo acoustic cell 10 by means of a fiber optic cable 13. The output pulses produced by cell 10 are amplified by fluidic amplifier 22 to boost the low level signals to a higher level. The amplified signal is now rectified by fluidic rectifier 42 to convert the modulated AC fluidic signals to varying DC pressure signals. The rectified signal is then amplified by a second fluidic amplifier 54 to boost the DC pressure or power output of the rectifier to a higher level and/or to provide differential DC control pressures to control actuator 62 which, for example, could be a piston, bellows or spool valve type actuator.

Figure 8:
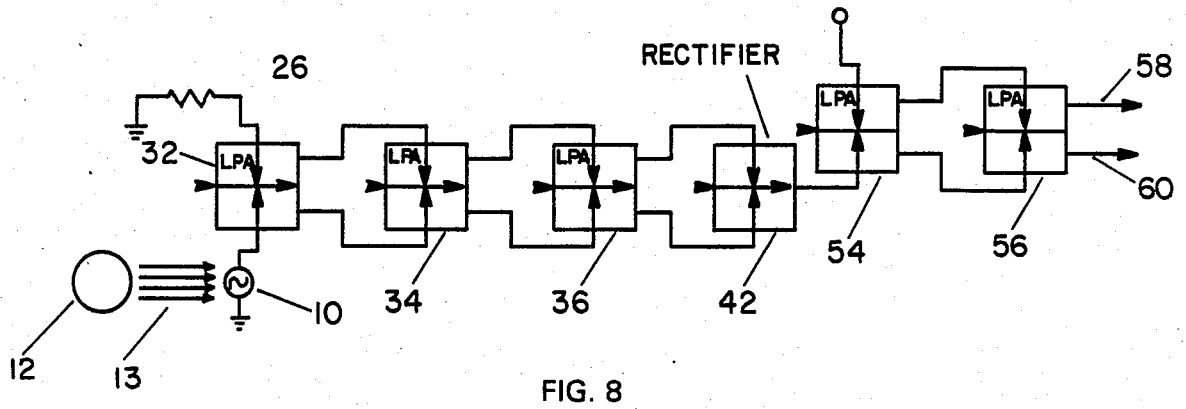
FIG. 8 is a schematic diagram of the entire photofluidic interface.

FIG. 8 is a schematic diagram further illustrating the assembled components of the photofluidic interface. Here the modulated light 14 is directed into the photo acoustic cell 10. The output pulses produced by cell 10 are amplified by a series of laminar proportional amplifiers 32, 34 and 36. The amplified signal is then rectified by fluidic rectifier 42 and the rectified signal is amplified by a second series of laminar proportional amplifiers 54 and 56.

While we have described and shown the particular embodiments of our invention, it will be understood that many modifications may be made without departing from the spirit thereof, and we contemplate by the appended claims to cover any such modifications as fall within the true spirit and scope of our invention.

What is claimed is:

1. A photofluidic interface for transducing optical signals to fluidic signals comprising:

a source of modulated electromagnetic energy that utilizes an optical carrier control signal that operates at a frequency in excess of 1000 Hz;

means for converting said electromagnetic energy to modulated fluidic signals;

means for fluidically amplifying said fluidic signals;

means for fluidically rectifying said fluidic signals; and an actuator responsive to said rectified signals.

2. The invention of claim 1 wherein said means for converting said electromagnetic energy comprises:

a housing;

a chamber with and open outlet within said housing for holding a volume of fluid;

a layer of energy absorbing material located within said chamber so as to receive said electromagnetic energy;

a window covering one side of said chamber; and a laminar jet positioned adjacent the open outlet of said chamber wherein said jet is utilized to create an acoustic impedance that blocks said open outlet of said chamber.

3. The invention of claim 2 wherein said electromagnetic energy is light and said window is transparent.

4. The invention of claim 1 wherein said electromagnetic energy is amplitude modulated.

5. The invention of claim 1 wherein said electromagnetic energy is frequency modulated.

6. The invention of claim 1 wherein said electromagnetic energy is pulse width modulated.

7. The invention of claim 1 wherein said electromagnetic energy is gate width modulated.

8. The invention of claim 2 wherein said energy absorbing material is carbon black.

9. The invention of claim 2 wherein said volume of fluid is air.

10. The invention of claim 2 further comprising means for directing said electromagnetic energy from said source to said window.

11. The invention of claim 10 wherein said means for directing said electromagnetic energy from said source to said window is comprised of optical fibers.

12. A method for transducing optical control signals into fluidic control pressures utilizing a photofluidic interface comprising:

directing light from a high frequency modulated light source onto a light sensitive target material located with a photo fluidic cell;

transfering the heat energy of the target material to an adjacent volume of fluid located within said photo fluidic cell thereby creating an AC acoustic current within said photo fluidic cell;

fluidically amplifying the output signal produced by the AC pressure signal of said photo fluidic cell;

fluidically rectifying the output signal of the fluidic amplification in order to produce a DC pressure output; and fluidically amplifying the output DC pressure signal of the fluidic rectification to create pressures to drive a control system.

13. The method of claim 12 wherein the modulated light source is comprised of a light emitting diode.

14. The method of claim 12 wherein the modulated light source is comprised of a modulated laser.

15. The method of claim 12 wherein the light from the modulated light source is relayed to the photo fluidic cell by optical fibers.

16. The method of claim 12 wherein the light sensitive target material is comprised of carbon black.

17. The method of claim 12 wherein the volume of fluid is air.

18. The invention of claim 2 wherein said operating frequency is at least 1400 Hz.

19. The method of claim 12 wherein the frequency of the modulated light source is at least 1400 Hz.

* * * * *